United States Patent [19]

Clements

[11] Patent Number: 4,765,511

[45] Date of Patent: Aug. 23, 1988

[54] TWIST CAP WITH INTEGRAL PUNCTURE MEANS

[76] Inventor: James W. Clements, 3 Greenfield Dr., Ancaster, Ontario, Canada, L9G 1M2

[21] Appl. No.: 912,547

[22] Filed: Sep. 29, 1986

[30] Foreign Application Priority Data

Oct. 18, 1985 [CA] Canada ..... 493311

[51] Int. Cl.[4] ..... B67B 7/24

[52] U.S. Cl. ..... 222/83; 222/91; 222/479; 222/529

[58] Field of Search ..... 222/80–81, 222/83, 85, 89–91, 479, 488–489, 528–529, 544–546, 568

[56] References Cited

U.S. PATENT DOCUMENTS

| | | | |
|---|---|---|---|
| 30,920 | 12/1860 | Hiney | 222/91 |
| 2,023,397 | 12/1935 | Blomgren | 222/90 |
| 2,173,779 | 9/1939 | Francois | 222/91 |
| 2,918,200 | 12/1959 | Libit | 222/545 X |
| 3,278,096 | 10/1966 | Miller | 222/545 X |
| 4,244,480 | 1/1981 | Planas | 215/320 |
| 4,323,165 | 4/1982 | Weick | 215/320 |
| 4,475,670 | 10/1984 | Rutter | 222/83 |
| 4,488,657 | 12/1984 | Deland | 215/303 |
| 4,690,304 | 9/1987 | Morel | 222/44 |

FOREIGN PATENT DOCUMENTS

| | | | |
|---|---|---|---|
| 611500 | 10/1960 | Italy | 222/546 |

*Primary Examiner*—Michael S. Huppert

[57] ABSTRACT

A captive closure with puncture means specifically designed as a replacement captive closure for liquid containing containers. The novel captive closure has a puncture means which allows it to puncture any sealing membrane over the pouring orifice of a container filled with distillates and the like and allows, by rotating one of its members relative to the other, a fluid flow communication through the closure so as to allow fluids to flow from the container out. Preferably the captive closure also includes a flexible pipe as part of the fluid conveying channel allowing fluid flowing from the container to be more readily poured into a destined reservoir or the like. An additional feature is a second channel, that acts as an air inflow channel, through the novel closure that is separate and apart from the fluid flow channel; the air inflow channel communicating upstream of the flow channel to the interior of the container thereby allowing air into the container during fluid outflow and thus encouraging more continuous outpouring of fluid. The air inflow channel has a novel feature that when the relative members of the closure are turned, the air flow channel is interrupted first, thereby encouraging rapid fluid flow reduction and on continuous relative turning, the fluid flow channel is then sealingly closed.

11 Claims, 4 Drawing Sheets

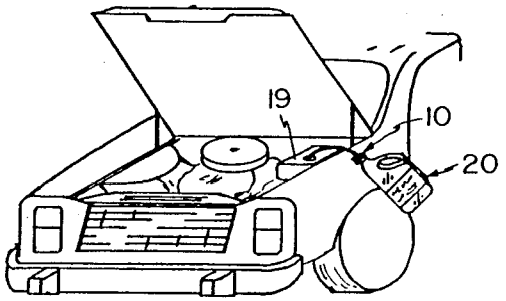
FIG. 3
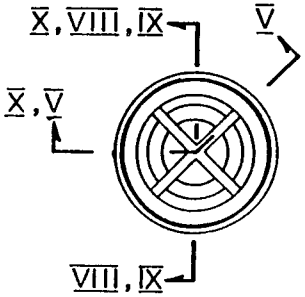
FIG. 4
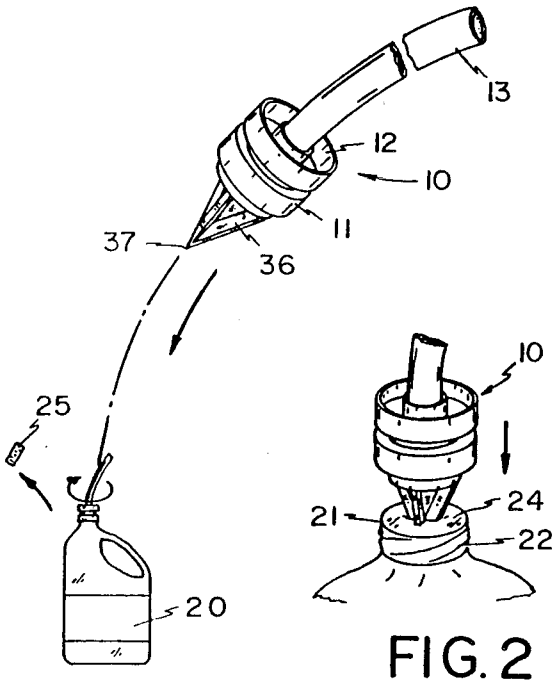
FIG. 2
FIG. 1

TWIST CAP WITH INTEGRAL PUNCTURE MEANS

This invention relates to a liquid container captive closure with puncture means.

The prior art is replete with various captive closures for constraining liquids in a container. Some provide a spout or pour means for facilitating the direction of the fluid outflow from the container. Some provide operator means to open and close the closure.

The modern delivery of cleaners, solvents and the like which have caustic active ingredients, or distilants in the liquid are generally packaged in specialized containers. Some of these containers have a pour means with a seal membrane which sealingly closes the pouring orifice of the container. The membrance is further constrained by a twist lock cap which surmounts the membrane and threadingly engages thread means surrounding the pouring orifice of the container. With first use of the solvent in the container, one must twistingly remove the cap, puncture the sealing membrane with a sharp object such as a pick or knife and then pour. Typically such containers include window washer cleaning fluids or cleaners for use in automobiles, sometimes known as wind screen cleaning solutions. The membrane is usually a polyethylene sheet or similar material and, in most instances is generally laminated with aluminum foil so that the polyethylene film sheet is a substrate of the laminant.

Containers of this general description are particularly common in North America and in Europe and are used in the specific application of containing window washer fluids and cleaners (wind screen cleaning solutions). The liquid contents, generally are water, a cleaning agent, distilates which reduce the freezing temperature of the solution to about −20° C., and colour or other cleaning additives. The container profile is such that generally the fluid contents of the container are to be poured into a reservoir located under the hood or the bonnet of an automobile. The reservoir communicates to an automatic window washer system for automatically washing the wind screen or windshield of the automobile on demand. Inadvertently, during initial pouring of cleaning fluid from the container into the reservoir, substantial amounts are lost because of the uncontrolled manner of pour toward, but not into the receiving reservoir.

It is an object of my invention to provide an improved closure therefor, particularly one that is a captive closure with puncture and has operator means for opening and closing the same with integral flexible spout so as to avoid the difficiencies of the prior art.

It is further an object of the invention to provide a second closable channel through my novel captive closure that acts as an air inflow channel during fluid out pouring of a fluid laden container having as its captive closure my novel captive closure. The air inflow channel is separate and apart from the fluid flow channel; the air inflow channel communicating upstream of the flow channel to the interior of the container thereby allowing air into the container during fluid outflow and thus encouraging more continuous outpouring of fluid. The air inflow channel has a novel feature that when the relative members of my closure are turned, the air flow channel is interrupted first, thereby encouraging rapid fluid flow reduction and on continuous relative turning, the fluid flow channel is then closed.

The invention contemplates a captive closure comprising;

(a) an annular cap;
  (i) including a body portion defining a central channel with a distal end carrying puncture means; and,
  (ii) means adapted for mounting the cap into sealing engagement with an out-pouring orifice of a container whose liquid is to be removed, so as to dispose the central channel into communication with the liquid; and, (b) an operative valve member adapted to mate with the body (a)(i) the valve member defining a flow canal that selectively communicates with the central channel so as to define the fluid flow channel;

(c) means for selectively moving the valve member and hence the central canal into and out of communication with the central channel;

The invention more precisely contemplates a captive closure comprising;

(a) an annular cap formed as
  (i) a cylindrical body defining a central channel that acts as part of a fluid flow channel, the body extending at its distal end into;
    (1) a plurality of vanes integral therewith, each extending from relative margins exterior of the central channel and tapering tcward and merging into a tip located in the prolongation of the central channel to thereby define a tapered puncture means, each vane defining between tip, each other and the distal end, a fluid flow space communicating with the central channel;
    (2) the vanes carrying therebetween a sealing plug placed orthogonal and coaxially subjacent to the central channel; and,
  (ii) means adapted for mounting the cap into sealing engagement with an out-pouring orifice of a container whose liquid is to be removed, so as to dispose the central channel and the vanes within the container; and, (b) an annular operative member including;
  (i) an annulus that steps into a cylindrical member defining a fluid flow canal, the diameter of which is slightly smaller than but proximate to that of the plug, the outside diameter of the cylindrical member being slightly smaller but proximate to the inside diameter of the central channel; and, (c) means for matingly moving the operative member relative to the annular cap so as to selectively place the plug into mating sealing engagement with the flow canal.

The movement means (c) preferably moves the members axial and they are relatively rotated and preferably an open to close cycle occurs every 180° of rotation. There is also provided a second channel which communicates into the interior of the container when the captive closure is in the fully open fluid flow position thereby allowing air to flow through the air flow channel into the container to assist in purging the same of the liquid.

In an alternative embodiment of the invehtion the airflow channel 70 may be central to the fluid flow channel 83 and hence there are coaxial tubes with the inner central core being the airflow channel and the surrounding outer coaxial being the fluid flow channel.

The invention will now be described by way of example and reference to the accompanying drawings in which;

FIG. 1 is a perspective view of an embodiment of the invention prior to its mating engagement with the orifice of a container;

FIG. 2 shows the embodiment of FIG. 1 penetrating the laminate membrane or barrier closing off the threading pour orifice of the container;

FIG. 3 shows the embodiment threadingly attached to the orifice of the container and in pouring operation;

FIG. 4 is a section along line IV—IV of FIG. 2;

Figure 9:
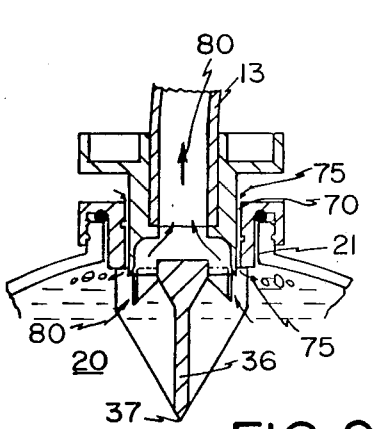
Figure 8:
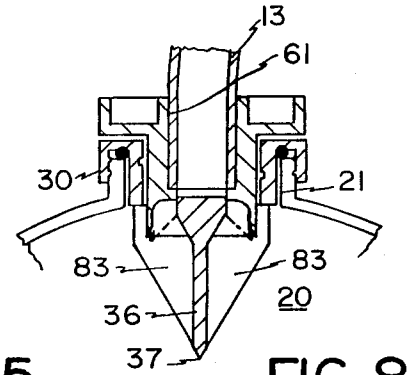

FIGS. 8 and 9 respectively are sections along VIII—VIII and IX—IX of FIG. 4 showing the closed captive position and the fluid flow position of the embodiment while on the container.

Figure 10:
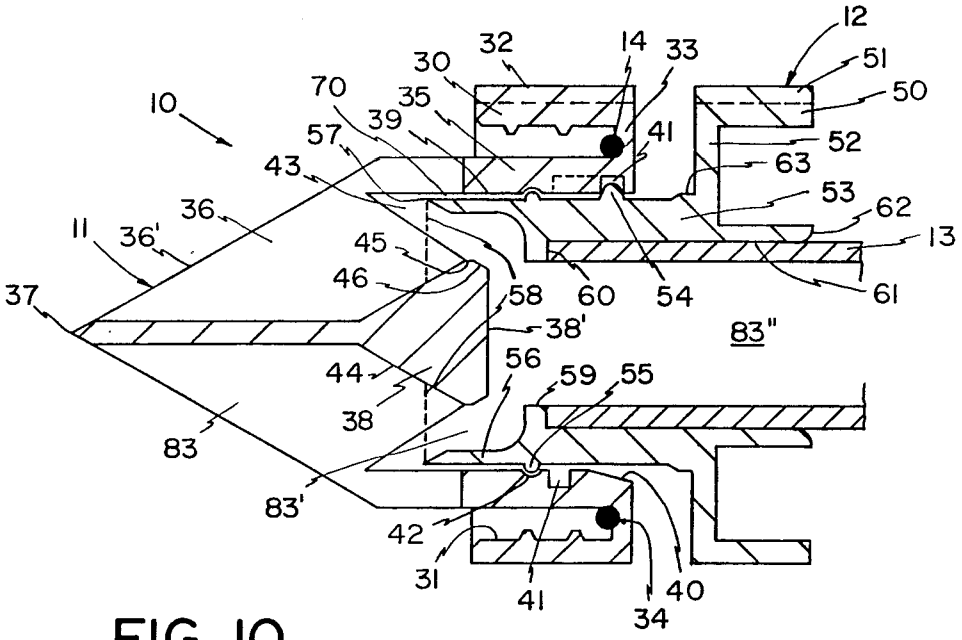

FIG. 10 is a more detailed cross-section along line IX—IX of FIG. 4 showing the fluid flow position of the preferred embodiment while on the container.

Figure 11:
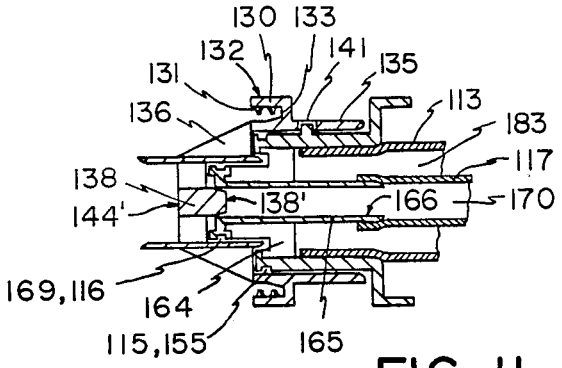

The alternative embodiment will now be disclosed by reference to the drawings in which:

FIG. 11 is a section, similar to that of FIG. 10, with the coaxial valve structure shown closed.

Figure 12:
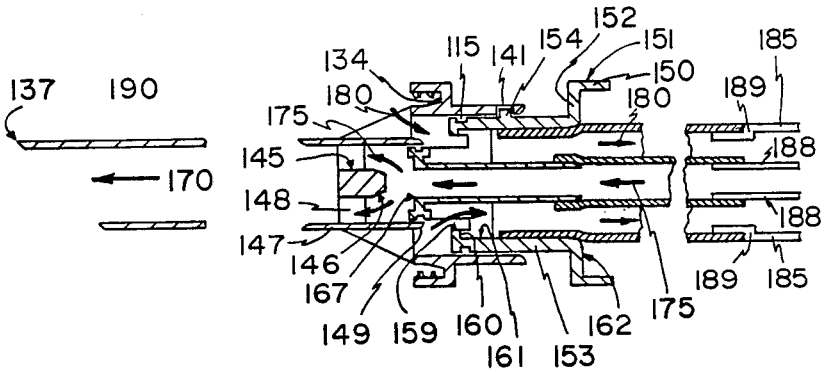

FIG. 12 is the section of FIG. 11 showing the coaxial valve open.

Figure 13:
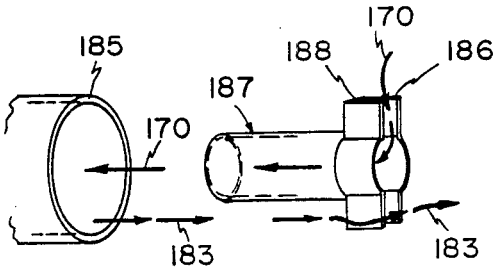

FIG. 13 is a partial assembly perspective of the alternative embodiment of the invention of FIGS. 11 and 12.

Referring to FIG. 1, my novel captive closure with puncture means is generally shown as 10 and includes 4 members 11, 12, 13 and 14, 3 of which are integral members; namely, a lower annular cap 11 that extends, as will be more apparent hereafter, into 4 radially disposed vanes 36 converging into a tip 37 that is located in the prolongation of a central aperture 39 defined by the annular cap 11; the vanes and tip cooperating to act as the puncture means. An upper rotatable operative member 12 matingly nests into the annular cap 11 in a manner as will become clearer hereafter. The member 12 defines therein a central canal 61 into which a flexible pipe or tube 13 nestingly fits and acts as the conveying means for fluid flow from a container generally shown as 20 in the figures. Optionally a seal 14, either in the form of an O-ring as shown in the drawings, or as a flat washer like annulus (not shown) is associated with the annular cap 11 to provide a seal between my novel captive closure 10 and container 20.

Figure 5:
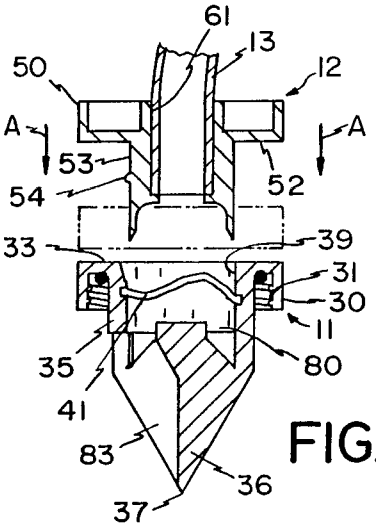
FIG. 5 is a section along V—V of FIG. 4.

Referring to FIGS. 1, 2 and optionally to FIGS. 5 and 10, my 4-part novel captive closure comprises the annular cap 11 and sealing O-ring 14 on the one hand, and rotating operative member 12, that acts as a valve therefor, and the outflow pipe 13.

The captive closure 10 replaces a throw-away cap 25 associated with the container 20 filled with fluid. That container 20 has an outpouring orifice 21, a seal 24 over the orifice 21, the seal being a laminated membrane generally composed of foil aluminum laminated on a substrate of polyethylene film. In such environment, the fluid (not clearly shown) within the container 20 is generally window washer fluid or the like. Circumscribing the outer margin of the orifice 21 are threads 22 whereby the cap 25 is threadingly engaged. The cap 25 is removed as by twisting, and my novel closure 10 is indexed into the membrane 24 as seen in FIG. 2 and pushed (arrows) in, whereby the membrane is broken by the combination of tip 37 and integral vanes 36. As will become more apparent, when referring to FIGS. 5 through 10, my novel cap 10 threadingly engages the threads 22 and provides a valve means for controlling fluid flow. Referring to in use operation, the liquid within the container 20 may be poured through my captive closure 10 and by flexible pipe 13 directed into a reservoir 19 under the bonnet or hood of an automobile. From this reservoir, on demand of the driver, window washer fluid is directed to the windscreen or window and cleaned by window wiper action.

Referring to FIGS. 5, 8 and 9, the lower annular cap 11 is generally in the form of a circumscribing annulus 30, with a threaded interior surface 31 adapted to threadingly engage threads 22 circumscribing the orifice 21 of the container 20. The exterior surface of the annulus 30 has ribs 32 which act much like a knurled surface for manual gripping so that the closure 10 may be threadingly engaged onto the orifice 21. The encircling annulus 30, at its upper edge steps radially inward into an end face annular ring 33. The end face 33 extends into a depending cylindrical body 35 that defines an interior central channel 39 for fluid flow, while the exterior perimeter of the body 35 has a radius slightly smaller than that of the orifice 21 so as to mate therein. Preferably, a gland or annular recess 34 is provided in the under-side of the end face 33 and it accommodates an O-ring 14 which, as will now be apparent to those skilled in the art, acts as the sealing means when my novel captive closure 10 is threadingly engaged on the container orifice 21.

The encircling annulus 30 therefore, at its upper end surface steps radially from the end face 33 into the central channel 39 defined by the cylindrical body 35. The channel 39 thus formed, defines in part the mid stream portion 83', 38" of a fluid flow channel, 83, 83', 83" for the liquid when poured from the container 20. The cylindrical body 35 is actually, a depending cylindrical piece integral at one end with the end face 33, but that at its distal end extends into 4 integral radial vanes 36 that taper toward each other and merge into a point or tip 37 being in the prolongation of the channel 39. As such the radial vanes 36 dispose a leading cutting surface 36' that cooperates with the tip 37 and act as puncture means (see FIG. 2) for piercing the membrane 24 surmounting the container orifice 21. This piercing is passively achieved when the closure 10 is pushed into the membrane 24, the direction of the arrow in FIG. 2.

The 4 radially converging vanes 36 define a flow space 83 between tip 37, each other, and the distal end of the cylindrical body 35. There is a common central axis of the radial vanes and it lies in the prolongation of the longitudinal axis of the cylindrical channel 39 as does the tip 37. The vanes 36 extend into a plug 38 with a flat disc like surface 38' that extends at the perimeter into a chamfered or circumscribing bevel 46 and thence at its outer circumference 45 into a truncated frustoconical surface 44 that convergingly merges with the central longitudinal axis of the vanes.

Figure 7:
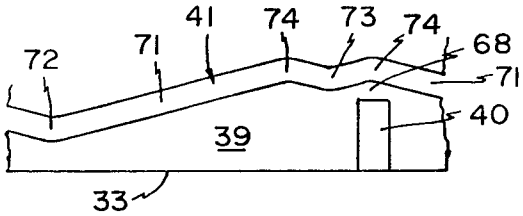
FIGS. 6 and 7 are respective sections VI—VI and VII—VII of FIG. 4 showing the respective mating of the operative components of the embodiment.
Figure 6:
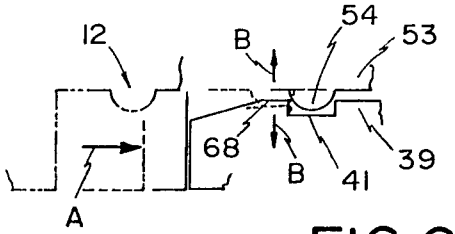

As is seen in FIGS. 5, 6, 7 and 10, the depending cylindrical body 35 not only defines the cylindrical channel 39, but the inner wall of that channel 39 defines a continuous cam race 41 and, referring to FIG. 7, the race 41 has a transitional slope 71 stepping from an open flow position 72 to a close flow position 73; the close position having on either side a switch back 74 for indexing the close position. A protrusion or bead 54 associated with the operative member 12 travels in the cam race 41 and depending upon its location in the race 41, laterally moves the operative member 12 relative to the annular cap 11 from the open flow position 72 of FIGS. 9 and 10, to the close fluid flow position 73 of FIG. 8, in a manner that will become more apparent hereafter. after.

Referring now to the operative member 12, and to FIGS. 5 and 10, the operative member 12 is also an annulus with an outer circumscribing annulus 50 defining on its outer surface gripping ribs 51. The circumscribing annulus 50 steps through an annular end face 52 into a cylindrical body portion 53 whose proximate end depends from the inner margin of the end face 52 to define an inner bore 61 that at its distal extremity steps through an annular step 60 into a minor bore 59. The cylindrical body 53 extends past the minor bore 59 into a major bore 58 of diameter larger than the other two bores and thence into a bevelled or pointed annulus 57 which defines the juncture of the inner and exterior surfaces of the cylindrical body 53 at the distal end; clearly seen in FIG. 10.

The inner bore 61 is sized to the exterior diameter of the flexible tube 13 while the bore 59 is sized to the interior diameter of the tube 13. When the tube 13 is mated into the bore 61, a continuous out-flow channel 83" is formed by the interior of the flexible tube 13 and bore 59; the major bore 58 likewise forms part of the continuous flow (arrows 80 in FIG. 9) channel 83' and 83". On the exterior wall of the body portion 53 a circumscribing rib or annulus 55 is provided as an integral protrusion circumscribing the body and, as will be seen hereafter, it cooperates with a corresponding recess 42 defined in the wall 39 of the annular cap 11 and cooperates therewith to provide therebetween (that is between the bodies 35 and 53, when in the mating open flow positions of FIGS. 9 and 10), a passage 70 for air flow (arrows 75 in FIG. 9) exterior to the fluid flow passage 83, 83' and 83". The exterior wall of the cylindrical body 53 is also provided with a bulbous protrusion 54 that is in fact a cam follower that indexes and travels in the cam race 41. In the simplest embodiment, there is only one such cam protrusion 54 (but as will become apparent there could be more). Depending upon the position of the cam 54 in the cam race 41, the valve will either be in the open flow position of FIG. 9 (also FIG. 10) or in the close flow position of FIG. 8 or somewhere in between. From the aforesaid, it will be seen therefore that the exterior diameter of the cylindrical valve body 53 is slightly smaller, by a few thousandths of an inch, than the inner diameter of bore 39. Similarly, the exterior radius of the plug 38 (radius at 45) is slightly larger than the diameter of minor bore 59. The annular bevel thereby defined by 46 facilitates alignment of the plug 38 into a throat defined by bore 59 and ensures "closing" and sealing of the liquid flow channel 83" from the contiguous flow channels 80 and 83' when the closure 10 is in the close flow position 73 of FIG. 8.

From the aforesaid, it will be seen therefore, the flexible tube 13 may be made of any extruded material; while that of the lower annular cap 11 and of the upper annular operative member 12 that acts as the valve means, of an appropriate molded material. In order to assist in assembling and particularly to allow the cam protrusion 54 to be indexed into the cam race 41, the channel 39 defines a recess or ramp 40 notched into the inner diameter of the annular surface 33 and extending toward the cam race 41 in a fashion as shown in FIG. 7. In assembly, the protrusion or cam 54 is indexed into this assembly ramp 40 and the valve 12 mated into the cap 11 following the fashion of arrows A in FIGS. 5 and 6 whereupon the cam 54 travels through the assembly ramp 40 across separation region 68 whereby both, and now referring to the phantom positions in FIG. 6, cam 54 and region 68 give as arrows B indicate, and on further pushing in the direction of arrows A, the cam 54 "snaps" into the cam race 41 as shown in solid in FIG. 6; also clearly seen in FIG. 10.

As will now be understood, when the operative annular valve member 12 is rotated 180°, the cam 54 travels through the cam race 41 and laterally moves the annular valve 12 relative to the cap 11 from either the close flow position of FIG. 8 through transition positions not shown to the open flow position of FIGS. 9 and 10. Because of the switch back regions 74 in the race 41, there is an apparent "locking" of the cam in the close flow position 73. When in this position, the members are as shown in FIG. 8. It will now be appreciated, that on rotating from the close flow position through the switch back 74 toward the open flow position that the radially outwardly extending annulus 55 on the cylindrical body 53 is moved to index with the corresponding annular recess 42 from frictional engagement with the bore 39 thereby opening the air circumferential flow path 70. Air flows from outside into the container. When the cam 45 moves into the transitional region 71, annulus 55 moves out of recess 42 into sealing contact with the walls of bore 39 inhibiting air flow and a vacuum is thereby set up in the container which has the tendency to virtually immediately slow down the volume of fluid flowing out the out flow channels 83, 83' and 83", notwithstanding the fact that the plug 38 has not yet indexed into full mating closure, sealed off throat 59 to isolate channel 83' from 83".

Preferably the cylindrical body 53 and its distal bevelled extremity 57 extend continuously into the vane notch portions 43 as shown in FIG. 10. The cylindrical body portion 53 and its distal bevelled annular extremity 57 should be of a length that extends well into corresponding notches 43 that are defined by the radial vanes 36 at a location remote from the distal end of the cylindrical body 35 so that the notches 43 in the vanes intersect flow spaces 53. As such, when in the full open flow position of FIG. 10, the bevelled extremity 57 extends past the distal end of the cylindrical body 35 of the cap 11 while the air-flow channel 70 formed between the cylindrical bodies 35 and 53 communicates with the interior of the container effectively upstream of the fluid flow channels 83, 83' and 83"; that is at bevelled annulus 57. The cross-sectional fluid flow area 58 which is defined by the flow channel 83' is greater than the fluid flow channel 83"; the liquid flow is slower in that region because a pressure differential exists such that the pressure in fluid flow region 83' and air flow region 70 at tip 57 is higher than that in the fluid flow region 83"; hence air will be passed into the container 20 and not into the fluid flow channels 83' and 83". This avoids air purging inwardly through air flow channel 70 and thence outwardly into annular flow channels 83' and 83", which would avoid replacement air being fed into the container to replace the fluid passing out the out pour channels 83, 83' and 83".

It should be appreciated, that in FIG. 9 the air flow stream 75 into the container is shown as is the fluid out flow 80, but the container is depicted in the upright position (not pictorially accurate when fluid is pouring).

In the figures, only one cam protrusion 54 is shown; hence the cam race 41, is one flight or wave length, and as shown in FIG. 7; there is only one stop position 73 and one open position 72 in the race. Thus 360° of relative rotation of the operative member and cap portion is required to move the members from the full fluid flow position through the full close position and back to the full fluid flow position. If there be 2 cams 54 disposed on diametrical sides of the cylindrical body 53, the cam race is 2 flights or "2 wave lengths" long, that is, there are 2 fluid flow close positions 72 and 2 fluid flow open positions 73 disposed in diametrical relation in the race 41. This has the advantage in that only 180° of rotation is required to move from the open through the close, to the open position again. Hence 90° of rotation will move the members from either fully open to fully close or fully close or visa versa. Further, because of the diametrically opposed cams, the angle of the transition region 71 of the cam race 41, the linear forces for moving the members axially from close to open or open to close position is equal on diametrically opposite sides of the members. There is a tendency for less binding between the members than if there were only one cam and the race was only one wave length or flight. Those skilled in the art will now appreciate that the number of cams and hence the number of flights in the cam race can be greater than 2, but the relative angle of the transition area 71 increases dramatically from approximately 18° when 2 diametrical cams are used, to 30° when 3 equi-radial cams are used to 45° (basically an unacceptable inclination) when 4 cams are used.

In FIGS. 11 and 12 the numerical references to the parts thereon correspond to those in FIGS. 1 through 10 save and except they are in the hundred series, with the appropriate additions and ommissions.

Hence, and referring to FIGS. 11 and 12 the captive closure 110 has a lower annular cap 111, generally in the form of a circumscribing annulus 130 with a threaded interior surface 131 adapted to threadingly engage threads 122 circumscribing the orifice 121 of the container 120. The exterior surface of the annulus 130 has ribs 132 which act like a knurled surface for manual gripping so that the closure 110 may be threadingly engaged onto the orfice 121. The encircling annulus 130, at its distal end steps radially inward into an integral end face annular ring 133. The end face 133 extends into a depending cylindrical body 135 that defines an interior central channel 139 for mounting and carrying the operative member 112. Preferably, a gland or annular recess 134 is provided in the under-side of the end face 133 and it is sized proximate to the end face of orifice 121 and may optionally accomodate an O-ring 114, which, as will now be apparent to those skilled in the art, acts as the sealing means when my novel captive closure 110 is threadingly engaged on the container orifice 21. The gland 134 steps into a frusto-conical exterior surface 176 on the exterior of body 135 which acts as a means of centering the end face of orifice 121 with the gland 134. The frusto-conical surface 176 at its distal and narrowest end steps into an annular surface 177 of a radius that is proximate to but slightly smaller than that of the container orifice 21 so as to facilitate the mating orifice 21 within the recess bounded by 130, 133, 134, 176, 177 and optionally 114.

On the distal end of this cylindrical member 135 extend vanes 136, which converge inwardly to attach to the exterior of and support the hollow cylindrical body 147, which itself is attached to and is supported by its inner bore, as well as the vanes 148 which converge inwardly to attach to and support the cylindrical body or plug 138.

The body 135 extends past ring 133 and a cam race 141 extends from the inner bore 139 through to the exterior surface of body 135.

The operative member 112, engages the annular cap 111 in a manner as earlier described with reference to FIGS. 1 through 10 and the cam action as earlier disclosed employs a cam 154 that travels through its race 141 to engage and disengage into sealing engagement the novel captive closure 110 in a manner similar to that as earlier disclosed with reference to FIGS. 1 through 10 save and except that the cam race 141 which extends entirely through the body 135 is not contagious about the circumference of the body 135 but is, preferably, two or more identical races, each being defined as commencing with an open flow position 172, continuing through a transitional slope 171 and a switch back 174 and ending in a closed flow position 173.

The encircling annulus 150 steps inwardly through an end face annular ring 152 into a cylindrical body 153 which has at its distal end a bevelled end face 162 which steps into an inner major bore 161 which steps through an annular step 160 into a minor bore 159. At the distal end of the exterior surface of the cylindrical member 153 a gland or annular recess 155 is provided to accomodate an O-ring 115 which seals the channel between bodies 135 and 153. From the inner bore 159 depend vanes 164 and thence the cylindrical body 165 which defines a bore 166. The cylindrical prolongation 165 has its distal end 167, of its inner diameter 166, sized to the diameter of the circumscribing bevel 146 of the plug 138. The cylindrical member 153 has the distal end of its inner diameter 159 sized to the outer diameter of the circumscribing bevel 149 of the body 147. On the distal exterior end of the cylindrical body 165 is a gland or annular recess 169 for an O-ring seal 116, to sealingly engage the cylindrical bodies 165 and 147 throughout operation.

The fluid flow tube 113 is of a larger diameter and coaxial to a smaller diameter airflow tube 117. As clearly seen in FIGS. 11 and 12 the fluid flow tube 113 frictionally engages on the inner surface 161 of the orifice defined by the operative member 112 and is carried thereby. The airflow tube 117 frictionally engages on the exterior surface of a central cylindrical prolongation 165 that is integral with the operative member 112.

Referring to FIGS. 12 through 19, a passive member 118 is disclosed generally in the form of a circumscribing annulus 185 which has, extending from its interior diameter, a plurality of, preferably two, bridges or troughs each formed by two sides 186 and a bottom 187 with the bottoms 187 extending toward the center of body 185 and with the distal ends of the troughs stepping into and integral with a central cylindrical member 188 that is coaxial with the annulus 185. The exterior cylindrical surface of the annulus 185 is a ribbed 189 and frictionally engages with the interior of the fluid tube 113. The surface 189 steps into an annular ring 181 which steps outwardly into the surface 182 which has its exterior diameter proximate to the exterior diameter of tube 113. The body 188 is frictionally engaged with the air tube 117. This allows air to pass inwardly over the edge of 185" into the trough formed by the inner bottom 187" and the sides 186" and thence into the inner bore 188" thus keeping the air inflow 170 separate from the fluid outflow 183, which passes 185' and 188'; the flow continues past 187' onward between the surfaces 185' and 186' to the exterior. The fluid outflow 183 is thus clearly seen to be divided into two separated streams with a clear space for air inflow 170 existing between the fluid streams. The air channel diverting plug 118 is only shown in FIG. 12. Optionally, the channel defined by the sides 186 and bottom 187 of the troughs may extend radially outwards through the body 185 to the limit of the exterior diameter of 185; thus, eliminating that portion of 185 that would be within the channel.

A separate inner air tube 190 frictionally engages at its distal end with body 147. The tubular extension 190 has at its opposite distal and a hollow beveled point 137 which acts as a puncture means for severing the foil 125 over the container orifice 121.

The tubular air channel extensions 190 is only shown in FIG. 12 and of course it will be appreciated and is contained within the bottle or container 120 when in use.

The embodiments of the invention in which an exclusive property or privilege is claimed are defined as follows:

1. A captive closure comprising;

(a) an annular cap member formed as (i) a cylindrical body defining a central channel that acts as part of a fluid flow channel, the body extending at its distal end into;

(1) a plurality of vanes integral therewith, each extending from relative margins exterior of the central channel and tapering toward and merging into a tip located in the prolongation of the central channel to thereby define a tapered puncture means, adjacent vanes defining between tip, each other and the distal end, a fluid flow space communicating with the central channel;

(2) the vanes carrying therebetween a sealing plug sized larger than the central channel and located coaxially subjacent to the central channel; and, (ii) means adapted for mounting the cap into sealing engagement with an out-pouring orfice of a container whose liquid is to be removed, so as to dispose the central channel and the vanes within the container;

(b) an annular operative member including;

(i) an annulus that steps into a cylindrical member defining a fluid flow canal, the diameter of which is slightly smaller than but proximate to that of the plug, the outside diameter of the cylindrical member being slightly smaller but proximate to the inside diameter of the central channel; and, (c) means for matingly moving the operative member relative to the annular cap so as to selectively place the plug into mating sealing engagement with the flow canal.

2. The captive closure as claimed in claim 2, wherein means for matingly moving the operative member relative to the cap moves the operative member coaxially relative to the annular member.

3. The closure as claimed in claim 2, wherein means for matingly moving the operative member relative to the cap includes a continuous meandering recess defined by an interior surface of one of the members and communicating with a channel defined by that surface, the recess defining therealong a close liquid flow cam position and an open liquid flow cam position; the other member defining a protuberance on that surface which is juxtaposed with the recess when the members are in mating position so that the protuberance acts as a cam and is adapted to index into and travel through the meandering race thereby coaxially moving the members relative to each other so that the canal is placed into and out of sealing engagement with the plug depending upon the relative position of the cam in the cam race.

4. The captive closure as claimed in claim 3 including a circumferential annular ring disposed on that surface of one of the members that is in juxtaposition with a mating surface of the opposite member, the annular ring adapted to fit and urge against the opposite member to form a sealing fit therewith when the members are not in the open flow position.

5. The captive closure as claimed in claim 3 including a circumferential annular ring disposed on the outside surface of the cylindrical member in close proximity to its distal end and adapted to matingly fit and urge against the cylindrical body to form a sealing fit therewith when the annular operative member is not in the open flow position relative to the annular cap.

6. The closure as claimed in claim 3, wherein there are two protuberances diametrically opposed to each other in the cam race as two diametrically opposed flights.

7. The closure as claimed in claim 3, wherein there are three radially protruding cams relatively positioned 120° on from the other and there are three corresponding flights.

8. The closure as claimed in claim 2, wherein means for matingly moving the operative member relative to the cap includes a continuous meandering recess defined by the central body and communicating with the central channel, the recess defining therealong a close liquid flow cam position and an open liquid flow cam position, the annular operative member defining a protuberance on its outside surface that acts as a cam and is adapted to index in and travel through the meandering race thereby coaxially moving the annular operative member and canal into and out of sealing engagement with the plug depending upon the relative position of the cam in the cam race.

9. The captive closure as claimed in claim 2 including a circumferential annular ring disposed on that surface of one of the members that is in juxtaposition with a mating surface of the opposite member, the annular ring adapted to fit and urge against the opposite member to form a sealing fit therewith when the members are not in the open flow position.

10. The captive closure as claimed in claim 2 including a circumferential annular ring disposed on the outside surface of the cylindrical member in close proximity to its distal end and adapted to matingly fit and urge against the cylindrical body to form a sealing fit therewith when the annular operative member is not in the open flow position relative to the annular cap.

11. The closure as claimed in claim 1, wherein means for matingly moving the operative member relative to the cap includes a continuous meandering recess defined by the central body and communicating with the central channel, the recess defining therealong a close liquid flow cam position and an open liquid flow cam position, the annular operative member defining a protuberance on its outside surface that acts as a cam and is adapted to index in and travel through the meandering race thereby coaxially moving the annular operative member and canal into and out of sealing engagement with the plug depending upon the relative position of the cam in the cam race.

* * * * *